US011501912B2

(12) United States Patent
Kusawake et al.

(10) Patent No.: US 11,501,912 B2
(45) **Date of Patent: *Nov. 15, 2022**

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazushi Kusawake, Mie (JP); Shintaro Nanbara, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 571 days.

This patent is subject to a terminal disclaimer.

(21) Appl. No.: 16/488,627

(22) PCT Filed: Feb. 8, 2018

(86) PCT No.: PCT/JP2018/004415
§ 371 (c)(1),
(2) Date: Aug. 26, 2019

(87) PCT Pub. No.: WO2018/159253
PCT Pub. Date: Sep. 7, 2018

(65) Prior Publication Data

US 2021/0134522 A1 May 6, 2021

(30) Foreign Application Priority Data

Feb. 28, 2017 (JP) ..... JP2017-035999

(51) Int. Cl.
*H01F 27/32* (2006.01)
*H01F 27/02* (2006.01)
(Continued)

(52) U.S. Cl.
CPC ..... *H01F 27/324* (2013.01); *H01F 27/022* (2013.01); *H01F 27/24* (2013.01); *H01F 37/00* (2013.01); *H01F 41/12* (2013.01)

(58) Field of Classification Search
CPC ..... H01F 27/324; H01F 27/022; H01F 27/24; H01F 37/00; H01F 41/12; H01F 3/10; H01F 27/2847
See application file for complete search history.

(56) References Cited

U.S. PATENT DOCUMENTS 3,643,196 A * 2/1972 Robin ..... H01F 27/324 336/84 R
2016/0314897 A1* 10/2016 Misaki ..... H01F 27/2823
(Continued)

FOREIGN PATENT DOCUMENTS

JP 2012-253289 A 12/2012
JP 2013-004531 A 1/2013
JP 2016-149453 A 8/2016

OTHER PUBLICATIONS

International Search Report, Application No. PCT/JP2018/004415, dated Apr. 10, 2018.

*Primary Examiner* — Mang Tin Bik Lian
(74) *Attorney, Agent, or Firm* — Honigman LLP

(57) ABSTRACT

A reactor includes a coil, a magnetic core having an inner core portion arranged inside a winding portion, and an inner interposed member insulating the winding portion from the inner core portion. The inner interposed member includes a thin portion with a small thickness, and a thick portion with a thickness larger than that of the thin portion. The inner core portion includes, on an outer peripheral face facing the inner interposed member, a core-side projecting portion with a shape conforming to a shape of the inner peripheral face of the thin portion. The thickness of the thin portion is 0.2 mm or more and 1.0 mm or less, and the thickness of the thick
(Continued)

portion is 1.1 mm or more and 2.5 mm or less. There is a clearance in at least part of a portion between the inner interposed member and the winding portion.

8 Claims, 5 Drawing Sheets

(51) Int. Cl.

| | |
|---|---|
| ***H01F 27/24*** | (2006.01) |
| ***H01F 37/00*** | (2006.01) |
| ***H01F 41/12*** | (2006.01) |

(56) References Cited

U.S. PATENT DOCUMENTS

| | | | | |
|---|---|---|---|---|
| 2018/0358172 | A1* | 12/2018 | Yamamoto | H01F 37/00 |
| 2019/0385778 | A1* | 12/2019 | Kusawake | H01F 27/324 |
| 2020/0243247 | A1* | 7/2020 | Kusawake | H01F 27/22 |
| 2021/0202149 | A1* | 7/2021 | Kusawake | H01F 3/14 |

* cited by examiner

REACTOR

CROSS-REFERENCE TO RELATED APPLICATIONS

This application is the U.S. national stage of PCT/JP2018/004415 filed on Feb. 8, 2018, which claims priority of Japanese Patent Application No. JP 2017-035999 filed on Feb. 28, 2017, the contents of which are incorporated herein.

TECHNICAL FIELD

The present disclosure relates to a reactor.

BACKGROUND

For example, JP 2012-253289A and JP 2013-4531A disclose reactors that are magnetic components used in converters of electric motor vehicles such as hybrid cars. The reactors of JP 2012-253289A and JP 2013-4531A include a coil having a pair of winding portions, a magnetic core that is partially arranged inside the winding portions, and a bobbin (insulating interposed member) that ensures insulation between the coil and the magnetic core.

With recent development of electric motor vehicles, it is required to improve performances of reactors. For example, it is required to suppress a change in magnetic characteristics of reactors caused by heat accumulating in the reactors, by improving the heat dissipation properties of the reactors. Furthermore, it is required for such reactors to be small and excellent in terms of magnetic characteristics. In order to satisfy these requests, researches have been repeatedly conducted on the configuration of reactors.

In view of these circumstances, it is an object of the present disclosure to provide a reactor that is excellent in terms of heat dissipation properties. Furthermore, it is another object of the present disclosure to provide a reactor that is small and excellent in terms of magnetic characteristics.

SUMMARY

The present disclosure is directed to a reactor, including: a coil having a winding portion; a magnetic core having an inner core portion arranged inside the winding portion; and an inner interposed member for ensuring insulation between the winding portion and the inner core portion, wherein the inner interposed member includes a thin portion with a small thickness due to an inner peripheral face thereof being recessed, and a thick portion with a thickness larger than that of the thin portion, the inner core portion includes, on an outer peripheral face thereof facing the inner interposed member, a core-side projecting portion with a shape that conforms to a shape of the inner peripheral face of the thin portion, the thickness of the thin portion is 0.2 mm or more and 1.0 mm or less, and the thickness of the thick portion is 1.1 mm or more and 2.5 mm or less, the inner core portion and the inner interposed member are in substantially close contact with each other, and there is a clearance in at least part of a portion between the inner interposed member and the winding portion.

DETAILED DESCRIPTION OF PREFERRED EMBODIMENTS

Figure 1:
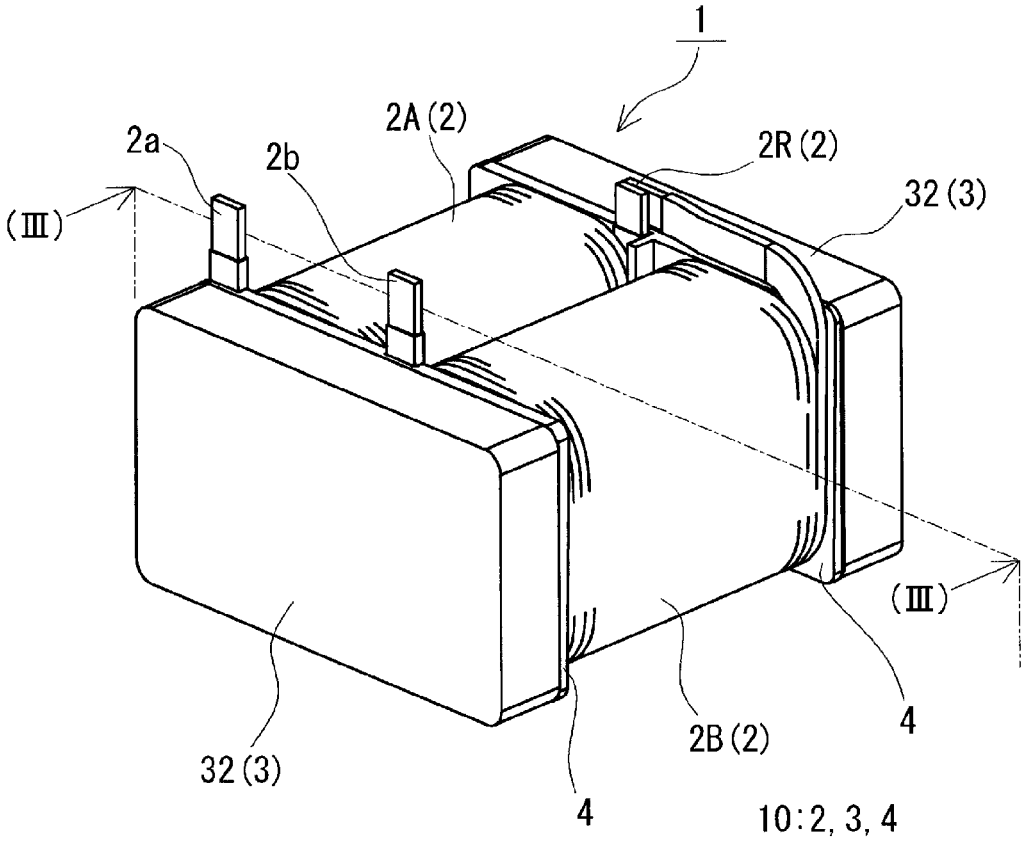
FIG. 1 is a schematic perspective view of a reactor including a coil having a pair of winding portions shown in Embodiment 1.

First, embodiments of the present disclosure will be listed and described.

In many cases, inner interposed members are formed through injection molding. When the thickness of inner interposed members is small, the dimensions of the injection molded products are likely to vary. Accordingly, conventionally, the thickness of inner interposed members is set to a predetermined value or more (e.g., 2.5 mm or more), or, as described in JP 2012-253289A and JP 2013-4531A, inner interposed members are provided with ribs, for example, so that the level of precision of the dimensions of the inner interposed members has been increased. However, with this configuration, the distance between a winding portion and an inner core portion increases. Accordingly, the heat dissipation properties from the inner core portion to the winding portion are limited, and, with a constant cross-sectional area of the winding portion, the cross-sectional area of a magnetic path of an inner core portion arranged inside the winding portion cannot be larger than a certain level. In view of these aspects, the inventors of the present disclosure completed a reactor according to embodiments described below.

An embodiment is directed to a reactor including: a coil having a winding portion; a magnetic core having an inner core portion arranged inside the winding portion; and an inner interposed member for ensuring insulation between the winding portion and the inner core portion, wherein the inner interposed member includes a thin portion with a small thickness due to an inner peripheral face thereof being recessed, and a thick portion with a thickness larger than that of the thin portion, the inner core portion includes, on an outer peripheral face thereof facing the inner interposed member, a core-side projecting portion with a shape that conforms to a shape of the inner peripheral face of the thin portion, the thickness of the thin portion is 0.2 mm or more and 1.0 mm or less, and the thickness of the thick portion is 1.1 mm or more and 2.5 mm or less, the inner core portion and the inner interposed member are in substantially close contact with each other, and there is a clearance in at least part of a portion between the inner interposed member and the winding portion.

When producing an inner interposed member through injection molding in which resin is injected into a mold, resin that is injected into portions with a large gap in the mold forms thick portions, and resin that is injected into portions with a small gap in the mold forms thin portions. The portions with a large gap in a mold have a function of quickly supplying resin to the entire gap in the mold. Accordingly, even when the inner interposed member includes the thin portion with a thickness smaller than that of conventional examples, if it includes the thick portion with a thickness that is greater than or equal to a predetermined thickness, it can be easily produced as designed. In order to bring the inner interposed member into substantially close contact with the outer periphery of the inner core portion, resin is molded on the inner core portion, or the inner core portion is press-fitted to the inner interposed member. In either case, the inner interposed member can be produced as designed, and thus the inner interposed member can be brought into substantially close contact with the outer periphery of the inner core portion. Here, in both cases in which resin is molded on the inner core portion and in which the inner core portion is press-fitted to the inner interposed member, there may be a gap at part of the boundary between the inner core portion and the inner interposed member. Even when there is a gap at part of the boundary, it is assumed that the inner core portion and the inner interposed member are in substantially close contact with each other, as long as the total area of the gap with respect to the entire boundary is small (e.g., as long as it is 40% or less, or 20% or less).

If variations in dimensions of the inner interposed member are small, even when the inner interposed member is designed such that the clearance between the inner interposed member and the winding portion is small, the occurrence of a problem that the inner interposed member cannot be inserted into the winding portion, for example, can be suppressed.

Since the clearance described above can be made smaller, the distance from the inner core portion to the winding portion can be made smaller, and the heat dissipation properties from the inner core portion to the winding portion can be improved. Furthermore, since the inner core portion and the inner interposed member are in substantially close contact with each other, the thermal conductivity between them is good, and thus the heat dissipation properties from the inner core portion to the winding portion can be improved. In particular, in the reactor according to the embodiment, since the core-side projecting portion of the inner core portion is arranged in the recess of the thin portion (hereinafter, it may be referred to as an "interposed-side recess portion"), the heat dissipation distance from the core-side projecting portion to the winding portion is short, and thus the heat dissipation properties of the reactor can be improved.

Furthermore, since the clearance described above can be made smaller, the cross-sectional area of a magnetic path in the inner core portion inside the winding portion can be increased, without increasing the size of the winding portion. In particular, in the reactor according to the embodiment, since the core-side projecting portion of the inner core portion is arranged in the interposed-side recess portion of the inner interposed member, the cross-sectional area of a magnetic path in the inner core portion can be increased. Accordingly, the cross-sectional area of a magnetic path in the inner core portion can be made larger than that in a conventional reactor using an inner interposed member having no interposed-side recess portion, without changing the size of the winding portion.

Furthermore, the configuration of this embodiment is advantageous in that vibrations of the inner core portion due to magnetostriction are likely to be suppressed by the inner interposed member that is in close contact with the outer periphery of the inner core portion.

The reactor according to an embodiment may be such that the inner interposed member is constituted by resin molded on an outer side of the inner core portion.

When forming the inner interposed member by arranging the inner core portion inside a mold and molding resin on the outer side of the inner core portion, resin that is injected into portions with a large gap between the outer peripheral face of the inner core portion and the inner peripheral face of the mold forms thick portions, and resin that is injected into portions with a small gap in the mold forms thin portions. If the inner interposed member is formed by molding resin on the inner core portion, the inner core portion and the inner interposed member can be reliably brought into close contact with each other. Furthermore, the inner core portion and the inner interposed member can be handled in one piece, and thus the productivity of the reactor can be improved.

The reactor according to an embodiment may be such that a difference between the thickness of the thin portion and the thickness of the thick portion is 0.2 mm or more.

If a difference between the thin portion and the thick portion is 0.2 mm or more, it is possible to suppress variations in dimensions of the inner interposed member, while sufficiently ensuring the resin injectability to a narrow portion in the mold corresponding to the thin portion.

The reactor according to an embodiment may be such that the thickness of the thin portion is 0.2 mm or more and 0.7 mm or less, and the thickness of the thick portion is 1.1 mm or more and 2.0 mm or less.

If the thickness of the thin portion is set to the above-described range, the distance between the winding portion and the core-side projecting portion of the inner core portion can be made sufficiently small, and thus the heat dissipation properties of the reactor can be further improved. Furthermore, if the thickness of the thick portion is set to the above-described range, variations in dimensions of the inner interposed member can be further suppressed.

The reactor according to an embodiment may be such that a plurality of the thick portions and a plurality of the thin portions are present in a dispersed manner in a circumferential direction of the inner interposed member.

In the mold for producing the inner interposed member with the above-described configuration, it is easy to supply resin into the entire gap in the mold when injecting the resin, and thus an inner interposed member with small variations in dimensions can be easily produced. That is to say, the inner interposed member with the above-described configuration is an inner interposed member with small variations in dimensions, and thus the heat dissipation properties and the magnetic characteristics of the reactor can be improved. In particular, if a portion with a small gap and a portion with a large gap are alternately arranged in the circumferential direction of the gap in the mold into which resin is injected, it is easier to supply resin to the entire gap in the mold. With this mold, an inner interposed member in which a thick portion and a thin portion are alternately arranged in the circumferential direction of the inner interposed member can be produced at a high level of precision of dimensions.

The reactor according to an embodiment may be such that at least part of the thick portion reaches an end face of the inner interposed member in an axial direction of the winding portion.

When producing an inner interposed member through injection molding, in many cases, resin is injected from a position in a mold at which an end face of an inner interposed member is to be formed. In this case, resin enters the mold from an end face of an inner interposed member, and thus, if a large gap corresponding to the thick portion is present at the entrance of resin, the moldability of the inner interposed member is improved. When producing an inner interposed member including a thick portion that reaches an end face of the inner interposed member, a portion with a large gap corresponding to the thick portion is formed at the entrance of resin. Accordingly, the inner interposed member with the above-described configuration is excellent in terms of moldability, and can be precisely produced even when the thickness of the thin portion is small.

The reactor according to an embodiment may be such that an outer peripheral face of the inner interposed member has a shape that conforms to an inner peripheral face of the winding portion.

If the outer peripheral face of the inner interposed member has a shape that conforms to the shape of the inner peripheral face of the winding portion, there is almost no gap between the inner interposed member and the winding portion, and the clearance between the outer peripheral face of the inner interposed member and the inner peripheral face of the winding portion can be easily made smaller. As a result, the heat dissipation properties and the magnetic characteristics of the reactor can be easily improved.

The reactor according to an embodiment may be such that a thickness of the inner interposed member gradually increases from the thin portion toward the thick portion.

If a thickness of the inner interposed member gradually increases from the thin portion toward the thick portion, the moldability of the inner interposed member can be improved. Examples of the configuration in which the thickness gradually increases from the thin portion toward the thick portion include a configuration in which a portion from the thin portion toward the thick portion is formed as a curved face or an inclined face. The moldability of the inner interposed member is improved due to the above-described configuration, because, when producing an inner interposed member through injection molding, resin that is injected into a portion, in the mold, at which the thick portion is to be formed smoothly flows into the portion at which the thick portion is to be formed.

The reactor according to an embodiment may be such that the clearance formed between the inner interposed member and the winding portion is more than 0 mm and 0.3 mm or less.

If the clearance described above is more than 0 mm and 0.3 mm or less, the heat dissipation properties and the magnetic characteristics of the reactor can be further improved.

Hereinafter, embodiments of the reactor according to the present disclosure will be described with reference to the drawings. Constituent elements with the same names are denoted by the same reference numerals in the drawings. Note that the present disclosure is defined by the claims without being limited to these configurations shown in the embodiments, and all modifications within the meaning and scope that are equivalent to the claims are intended to be included herein.

Embodiment 1

Overall Configuration

A reactor 1 shown in FIG. 1 includes an assembly 10 obtained by combining a coil 2, a magnetic core 3, and an insulating interposed member 4. One of the characteristics of the reactor 1 is that part of the insulating interposed member 4 (later-described inner interposed members 41 in FIGS. 2 and 3) has a shape different from that of conventional examples. First, constituent elements of the reactor 1 will be briefly described with reference to FIGS. 1 and 2, and then the shape of the inner interposed members 41, and a relationship between the inner interposed members 41, and the magnetic core 3 and winding portions 2A and 2B arranged inside and outside the inner interposed members 41 will be described in detail with reference to FIGS. 3 to 5.

Coil

The coil 2 in this embodiment includes a pair of winding portions 2A and 2B arranged side by side, and a connection portion 2R for connecting the winding portions 2A and 2B. Two ends 2*a* and 2*b* of the coil 2 respectively extend from the winding portions 2A and 2B, and are connected to an unshown terminal member. An external apparatus such as a power source for supplying electric power to the coil 2 is connected via this terminal member. The winding portions 2A and 2B included in the coil 2 of this example are substantially in the shape of angular tubes in the same winding direction with the same number of turns, and are arranged side by side such that their axial directions are in parallel with each other. The numbers of turns or the wire cross-sectional areas of the winding portions 2A and 2B may be different from each other. Furthermore, the connection portion 2R of this example is formed by joining the ends of wires of the winding portions 2A and 2B with each other through welding or crimping, for example. It is also possible that the coil 2 is formed by helically winding one winding wire with no joint portion.

The coil 2 including the winding portions 2A and 2B can be constituted by a coated wire including an insulating coating made of an insulating material on the outer periphery of a conductor such as a flat wire or a round wire made of a conductive material such as copper, aluminum, magnesium, or alloys thereof. In this embodiment, the winding portions 2A and 2B are formed by edgewise winding a coated flat wire in which a conductor is constituted by a copper flat wire and an insulating coating is made of an enamel (typically, polyamide imide).

Magnetic Core

Figure 2:
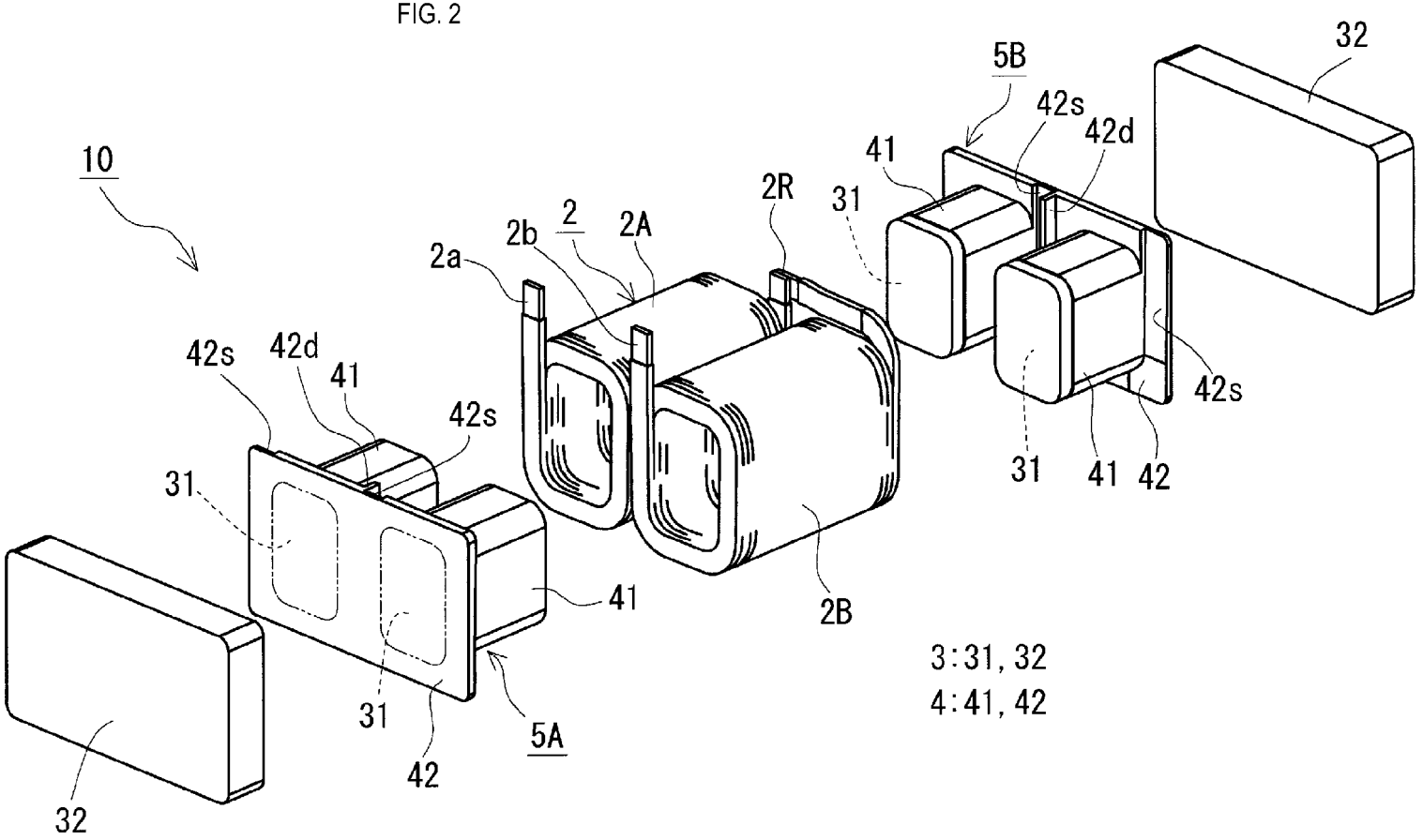
FIG. 2 is an exploded perspective view of an assembly of the reactor shown in Embodiment 1.

As shown in FIG. 2, the magnetic core 3 of this example can be divided into inner core portions 31 and outer core portions 32. The inner core portions 31 are portions arranged inside the winding portions 2A and 2B of the coil 2, and, in this example, are arranged inside the inner interposed members 41, and thus they are located at positions not seen in FIG. 2. The inner core portions 31 of this example are each formed by combining two divided pieces. Here, the inner core portions 31 refer to portions along the axial direction of the winding portions 2A and 2B of the coil 2, in the magnetic core 3. For example, portions projecting from the inside of the winding portions 2A and 2B to the outside of the end faces are also part of the inner core portions 31. The inner core portions 31 on the whole have a shape that substantially conforms to the inner shape of the winding portion 2A (2B), and, in the case of this example, the shape is substantially a cuboid.

The outer peripheral faces of the inner core portions 31 of this example have a concavo-convex shape. The concavo-convex shape of the outer peripheral faces of the inner core portions 31 conforms to the shape of the inner peripheral faces of the later-described inner interposed members 41. The configuration of this concavo-convex shape will be described later in detail with reference to FIGS. 3 to 6.

The outer core portions 32 are portions arranged outside the winding portions 2A and 2B, and each have a shape connecting ends of a pair of inner core portions 31. The outer core portions 32 of this example are each in the shape of a cuboid. The lower faces of the outer core portions 32 are substantially flush with the lower faces of the winding portions 2A and 2B of the coil 2 (see FIG. 1). It will be appreciated that the lower faces do not necessarily have to be flush with each other.

The core portions 31 and 32 may be constituted by molded articles made of a composite material containing soft magnetic powder and resin. The soft magnetic powder is an aggregate of magnetic particles made of iron-group metals such as iron or an alloy thereof (an Fe—Si alloy, an Fe—Si—Al alloy, an Fe—Ni alloy, etc.). The surface of magnetic particles may also be provided with an insulating coating made of phosphate or the like. Examples of the resin include thermosetting resins such as epoxy resins, phenolic resins, silicone resins, and urethane resins, and thermoplastic resins such as polyphenylene sulfide (PPS) resins, polyamide (PA) resins (e.g., nylon 6 or nylon 66), polyimide resins, and fluororesins.

The amount of soft magnetic powder contained in the composite material may be 50 vol % or more and 80 vol % or less, where the amount of composite material is assumed to be 100 vol %. When the amount of magnetic powder contained in the composite material is 50 vol % or more, the proportion of the magnetic component is sufficiently high, and it is easy to increase the saturation magnetic flux density. On the other hand, when the amount of magnetic powder contained in the composite material is 80 vol % or less, the mixture of magnetic powder and resin has high fluidity, and the composite material can exert excellent moldability. The lower limit of the amount of magnetic powder contained in the composite material may be 60 vol % or more. Furthermore, the upper limit of the amount of magnetic powder contained in the composite material may be 75 vol % or less, and further may be 70 vol % or less.

Contrary to this example, the core portions 31 and 32 also may be constituted by powder compacts that are obtained by compression molding a raw material powder containing soft magnetic powder. The soft magnetic powder may be the same as the soft magnetic powder that can be used for the molded articles made of the composite material. It is also possible that one of the inner core portions 31 and the outer core portions 32 is a molded article made of a composite material, and the other is a powder compact.

Insulating Interposed Member

The insulating interposed member 4 is a member for ensuring insulation between the coil 2 and the magnetic core 3, and is formed by combining the inner interposed members 41 interposed between the inner peripheral faces of the winding portions 2A and 2B and the outer peripheral faces of the inner core portions 31, and the end face interposed member 42 interposed between the end faces of the winding portions 2A and 2B and the outer core portions 32. In this example, the insulating interposed member 4 is used as a pair of molded core members 5A and 5B formed in one piece with the inner core portions 31. The molded core members 5A and 5B of this example may have the same shape, or the molded core member 5A located on the side on which the ends 2*a* and 2*b* of the winding portions 2A and 2B are arranged and the molded core member 5B located on the side on which the connection portion 2R is arranged may have different shapes.

The molded core members 5A and 5B are members that are each substantially in the shape of the letter "n" formed by combining a pair of inner core portions 31, a pair of inner interposed members 41 that respectively covers the outer peripheries of the inner core portions 31, and a frame-like end face interposed member 42 into one piece. In production of the molded core members 5A and 5B in which the inner interposed members 41 and the end face interposed member 42 are formed by arranging the inner core portions 31 inside a mold and injecting resin into the mold, a positioning member for locating the inner core portions 31 away from the inner peripheral face of the mold and positioning the inner core portions 31 inside the mold is used. Accordingly, in the molded core members 5A and 5B, the positioning member is embedded in the inner interposed members 41, that is, the positioning member constitutes part of the inner interposed members 41. In view of this aspect, it is preferable that the positioning member is made of an insulating resin. It is more preferable that, in order to align the coefficients of thermal expansion of portions of the inner interposed members 41, the entire inner interposed members 41 including the positioning member is the same type of insulating resin.

Two turn accommodating portions 42*s* (in particular, see the molded core member 5B) that accommodate axial direction ends of the winding portions 2A and 2B are formed on the face, on the coil 2 side, of each end face interposed member 42. The turn accommodating portions 42*s* are recesses with a shape that conforms to the shape of the axial direction end faces of the winding portions 2A and 2B, and are formed so as to allow the entire end faces to be in contact with the end face interposed member 42. Furthermore, a partitioning portion 42*d* that is arranged between the winding portions 2A and 2B and is used to partition the winding portions 2A and 2B from each other is formed on the face, on the coil 2 side, of each end face interposed member 42.

Here, each of the molded core members 5A and 5B of this example is molded such that the inner interposed members 41 and the end face interposed member 42 are formed in one piece, and the portions, indicated by the dashed double dotted lines, of the molded core member 5A are the inner interposed members 41.

The insulating interposed member 4 with the above-described configuration may be made of, for example, a thermoplastic resin such as a PPS resin, a polytetrafluoroethylene (PTFE) resin, a liquid crystal polymer (LCP), a PA resin (e.g., nylon 6 or nylon 66), a polybutylene terephthalate (PBT) resin, or an acrylonitrile butadiene styrene (ABS) resin. Alternatively, the insulating interposed member 4 may be made of a thermosetting resin such as an unsaturated polyester resin, an epoxy resin, a urethane resin, or a silicone resin. It is also possible to improve the heat dissipation properties of the insulating interposed member 4 by mixing a ceramic filler into the aforementioned resins. Examples of the ceramic filler include non-magnetic powder of alumina or silica.

Other Configurations

The reactor 1 of this example has a configuration without a casing, but also may have a configuration in which the assembly 10 is arranged inside a casing.

Figure 3:
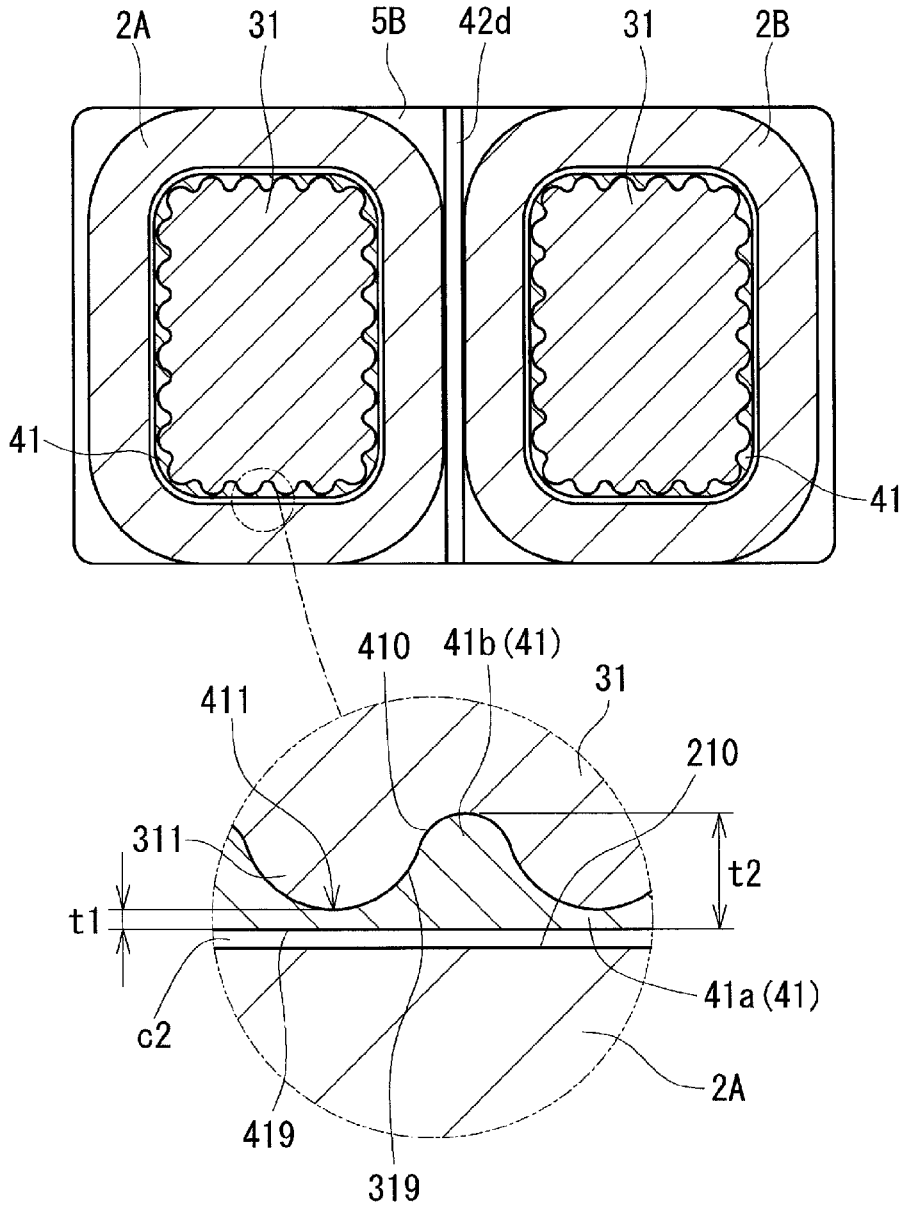
FIG. 3 shows a cross-sectional view taken along the line III-III in FIG. 1, and a partially enlarged view thereof.

Relationship Between Inner Interposed Member, and Inner Core Portion and Winding Portion FIG. 3 is a cross-sectional view taken along the line III-III that is orthogonal to the axial direction of the winding portions 2A and 2B in FIG. 1. In FIG. 3, the connection portion 2R is not shown. Furthermore, in FIG. 3, shapes of constituent elements and an clearance therebetween are exaggerated.

As shown in an enlarged view enclosed in a circle in FIG. 3, a plurality of interposed-side recess portions 411 are formed on an inner peripheral face 410 of the inner interposed member 41. The inner interposed member 41 includes thin portions 41*a* with a small thickness due to the inner peripheral face 410 being recessed to form the interposed-side recess portions 411, and thick portions 41*b* with a thickness larger than that of the thin portions 41*a*.

Figure 4:
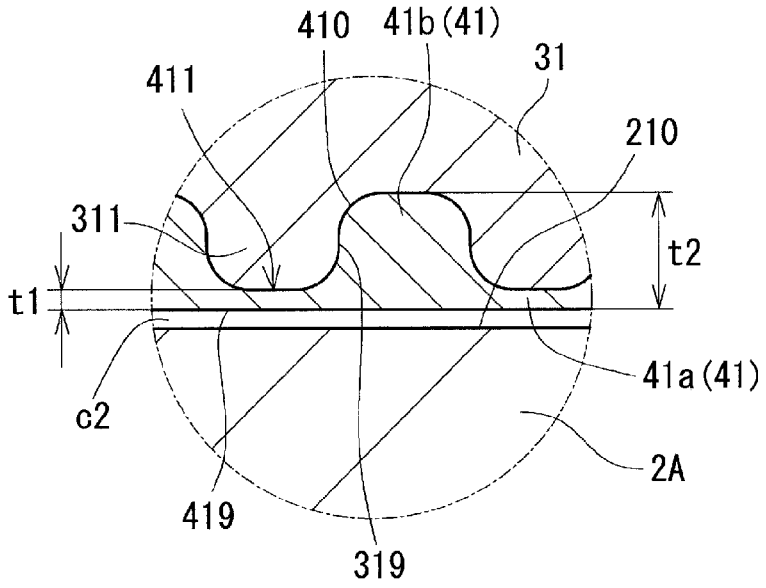
FIG. 4 is a partially enlarged view showing a positional relationship between an inner interposed member including an interposed-side recess portion different from that in FIG. 3, and an inner core portion and a winding portion arranged inside and outside the inner interposed member.

There is no particular limitation on the shape of the inner peripheral faces of the interposed-side recess portions 411 in a cross-section that is orthogonal to the direction in which the interposed-side recess portions 411 extend (the depth direction of the section of the diagram of FIG. 3, which is the same as the axial direction of the winding portions 2A and 2B). For example, the inner peripheral faces of the interposed-side recess portions 411 may be in the shape of semicircular arcs as shown in FIG. 3, or may be substantially in the shape of rectangles as shown in FIG. 4. Alternatively, the inner peripheral faces of the interposed-side recess portions 411 may be in the shape of V-shaped grooves or dovetail grooves.

A thickness t1 of the thin portions 41*a* is 0.2 mm or more and 1.0 mm or less, and a thickness t2 of the thick portions 41*b* is 1.1 mm or more and 2.5 mm or less. The thickness t1 of the thin portions 41*a* is the thickness of a portion corresponding to the deepest position in the interposed-side recess portions 411 as shown in FIGS. 3 and 4, that is, the smallest thickness of the thin portions 41*a*. The thickness t1 of the thin portions 41*a* is apparently smaller than the thickness of conventional inner interposed members with a uniform thickness (e.g., 2.5 mm). Furthermore, the thickness t2 of the thick portions 41*b* is the largest thickness at portions at which the interposed-side recess portions 411 are not present.

When producing the inner interposed members 41 with the above-described configuration on the outer peripheries of the inner core portions 31 through injection molding, resin that is injected into portions with a large gap between a mold for injection molding and the inner core portions 31 (hereinafter, referred to as a "gap in a mold") forms the thick portions 41*b*, and resin that is injected into portions with a small gap in the mold forms the thin portions 41*a*. The portions with a large gap in a mold have a function of quickly supplying resin to the entire gap in the mold. Accordingly, even when the inner interposed members 41 include the thin portions 41*a* with a thickness smaller than that of conventional examples, if they include the thick portions 41*b* with a thickness that is greater than or equal to a predetermined thickness, they can be easily produced as designed, and the inner interposed members 41 can be brought into substantially close contact with the entire outer peripheries of the inner core portions 31. If variations in dimensions of the inner interposed members 41 are small, the inner interposed members 41 can be designed such that an inner clearance c1 between the inner core portions 31 and the inner interposed members 41 and an outer clearance c2 between the inner interposed members 41 and the winding portions 2A and 2B are small. Even when the outer clearance c2 is small, the occurrence of a problem that the inner interposed members 41 cannot be inserted into the winding portions 2A and 2B, for example, can be suppressed because the level of precision of the dimensions of the inner interposed members 41 is high.

In consideration of the moldability of the inner interposed members 41, it is preferable that the plurality of interposed-side recess portions 411 are present in a dispersed manner in the circumferential direction of the inner peripheral faces 410 of the inner interposed members 41. In other words, this configuration is a configuration in which a plurality of thick portions 41*b* and a plurality of thin portions 41*a* are present in a dispersed manner in the circumferential direction of the inner interposed members 41. In the mold for producing the inner interposed members 41, a portion with a small gap and a portion with a large gap are alternately arranged in the circumferential direction of the gap in the mold into which resin is injected. In this mold, it is easy to supply resin into the entire gap in the mold when injecting the resin, and thus the inner interposed members 41 with small variations in dimensions can be easily produced. In particular, if the thin portions 41*a* and the thick portions 41*b* are along the axial direction of the inner interposed members 41 as in this example, it is easier to inject resin into the mold during molding.

Furthermore, in consideration of the moldability of the inner interposed members 41, it is preferable that at least some of the thick portions 41*b* reach the end faces of the inner interposed members 41 in the axial direction of the winding portions 2A and 2B. It is preferable that all the thick portions 41*b* reach the end faces of the inner interposed members 41 shown in FIG. 2. When producing the inner interposed members 41 through injection molding, in many cases, resin is injected from a position in a mold at which an end face of an inner interposed member 41 is to be formed. In this case, if the gap through which resin enters the mold is large, the moldability of the inner interposed members 41 is improved. That is to say, the inner interposed members 41 including the thick portions 41*b* that reach the end faces of the inner interposed members 41 are excellent in terms of moldability, and they can be precisely produced even when the thickness of the thin portions 41*a* is small.

Figure 5:
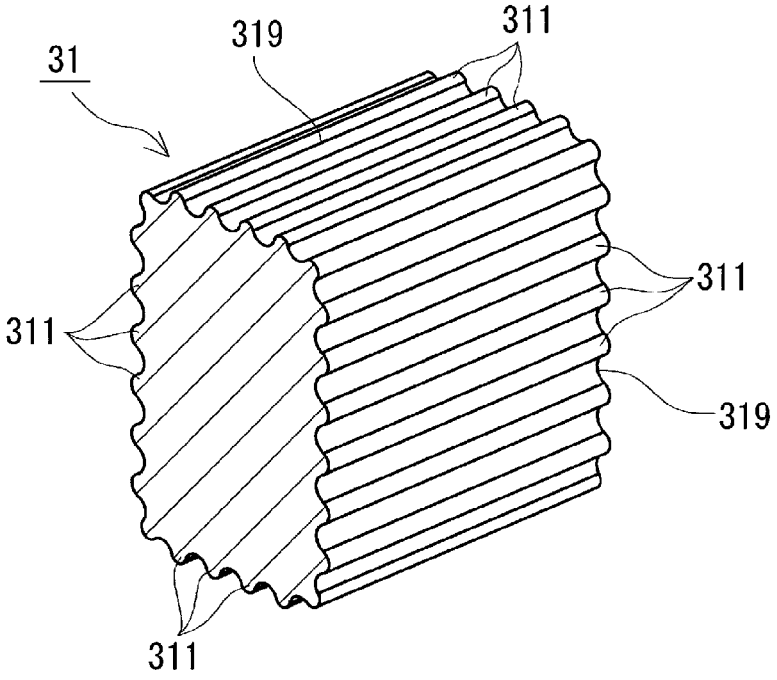
FIG. 5 is a schematic perspective view of an inner core portion shown in Embodiment 1.

Meanwhile, the inner core portion 31 arranged inside each inner interposed member 41 described above includes core-side projecting portions 311 that are formed on an outer peripheral face (the core outer peripheral face 319) of the inner core portion 31 (see FIG. 5 as well). In this example, the inner interposed members 41 are molded on the inner core portions 31, and thus the interposed-side recess portions 411 that are formed on the inner peripheral face 410 of each inner interposed member 41 are formed in a shape that conforms to the core-side projecting portions 311. As described above, the thickness of the thin portions 41*a* of the inner interposed members 41 at which the interposed-side recess portions 411 are formed is smaller than the thickness of conventional inner interposed members with a uniform thickness. Accordingly, the cross-sectional area of a magnetic path in the inner core portions 31 including the core-side projecting portions 311 that are arranged at the interposed-side recess portions 411 is reliably larger, by the cross-sectional area of the core-side projecting portions 311, than that of conventional inner core portions.

It is preferable that outer peripheral faces 419 of the inner interposed members 41 have a shape that conforms to the shape of the inner peripheral faces of the winding portions 2A and 2B. Accordingly, the outer clearance c2 between the outer peripheral faces 419 of the inner interposed members 41 and coil inner peripheral faces 210 of the winding portions 2A and 2B can be easily made smaller. Specifically, the outer clearance c2 can be easily made to more than 0 mm and 0.3 mm or less. Since the outer clearance c2 can be made smaller, the distance from the inner core portions 31 to the winding portions 2A and 2B can be made smaller, the heat dissipation properties from the inner core portions 31 to the winding portions 2A and 2B can be improved, and the cross-sectional area of a magnetic path in the inner core portions 31 can be increased. The outer clearance c2 is preferably 0.2 mm or less, and more preferably 0.1 mm or less, in order to smoothly insert the inner interposed members 41 into the winding portions 2A and 2B, to improve the heat dissipation properties from the inner core portions 31 to the winding portions 2A and 2B, and to increase the cross-sectional area of a magnetic path in the inner core portions 31.

More Preferable Configurations

In consideration of the fact that portions that have a large gap in a mold and that correspond to the thick portions 41*b* provide good moldability of the inner interposed members 41, it is preferable that the difference between the thickness t1 of the thin portions 41*a* and the thickness t2 of the thick portions 41*b* (the thickness t2—the thickness t1) is 0.2 mm or more. When the thin portions 41*a* and the thick portions 41*b* are prescribed as specific numerical values, it is preferable that the thickness t1 of the thin portions 41*a* is 0.2 mm or more and 0.7 mm or less, and the thickness t2 of the thick portions 41*b* is 1.1 mm or more and 2.0 mm or less, and it is more preferable that the thickness t1 of the thin portions 41*a* is 0.2 mm or more and 0.5 mm or less, and the thickness t2 of the thick portions 41*b* is 1.1 mm or more and 2.0 mm or less.

If the thickness of the inner interposed members 41 gradually increases from the thin portions 41*a* toward the thick portions 41*b*, the moldability of the inner interposed members 41 can be improved. The reason for this is that, when producing the inner interposed members 41 through injection molding, resin that is injected into portions, in the mold, at which the thick portions 41*b* are to be formed smoothly flows into the portions at which the thin portions 41*a* are to be formed. Specific examples of this configuration include a configuration as shown in FIGS. 3 and 4 in which a width direction edge of each thin portion 41*a* (an edge in the direction in which a thick portion 41*b* is present) has a rounded shape that is recessed to the outside of the inner interposed member 41. It is also preferable that a width direction edge of each thick portion 41*b* (an edge in the direction in which a thin portion 41*a* is present) has a rounded shape that is projected to the outside of the inner interposed member 41. The above-described width direction edges may be in the shape of an arc, and, in this case, the radius of curvature of the arc may be 0.05 mm or more and 20 mm or less, and further may be 0.1 mm or more and 10 mm or less. If the radius of curvature of the arc is large, as shown in FIG. 3, the width direction edges of the thin portions 41*a* and the width direction edges of the thick portions 41*b* are connected, and the inner peripheral faces 410 of the inner interposed members 41 are in the shape of waves. On the other hand, if the radius of curvature of the arc is small, as shown in FIG. 4, the inner peripheral faces 410 of the inner interposed members 41 have a shape in which the interposed-side recess portions 411 in the shape of rectangular grooves with rounded corners are arranged in a line. Alternatively, the inner peripheral faces 410 of the inner interposed members 41 may have a shape in which the interposed-side recess portions 411 in the shape of V-shaped grooves with rounded corners are arranged in a line.

In the configuration in which the inner interposed members 41 are molded on the outer peripheries of the inner core portions 31, it is preferable that the inner core portions 31 each include a plurality of core-side projecting portions 311 that are formed on the core outer peripheral face 319, as shown in FIG. 5. The core-side projecting portions 311 in FIG. 5 are formed in the shape of ridges along the axial direction of the inner core portions 31, and the core-side projecting portions 311 are arranged at predetermined intervals in the circumferential direction of the core outer peripheral face 319. With such inner core portions 31, it is easy to supply resin into the entire core outer peripheral faces 319 when molding resin from the end face side of the inner core portions 31. The reason for this is that grooves formed between the core-side projecting portions 311 allow resin to move smoothly in the axial direction of the inner core portions 31, and thus the resin is supplied from the positions of the grooves also to the outer peripheries of the core-side projecting portions 311. If the inner core portions 31 are used, the interposed-side recess portions 411 of the inner interposed members 41 extend from end faces on one side to end faces on the other side in the axial direction of the inner interposed members 41 (which is the same as the axial direction of the winding portions 2A and 2B).

Figure 6:
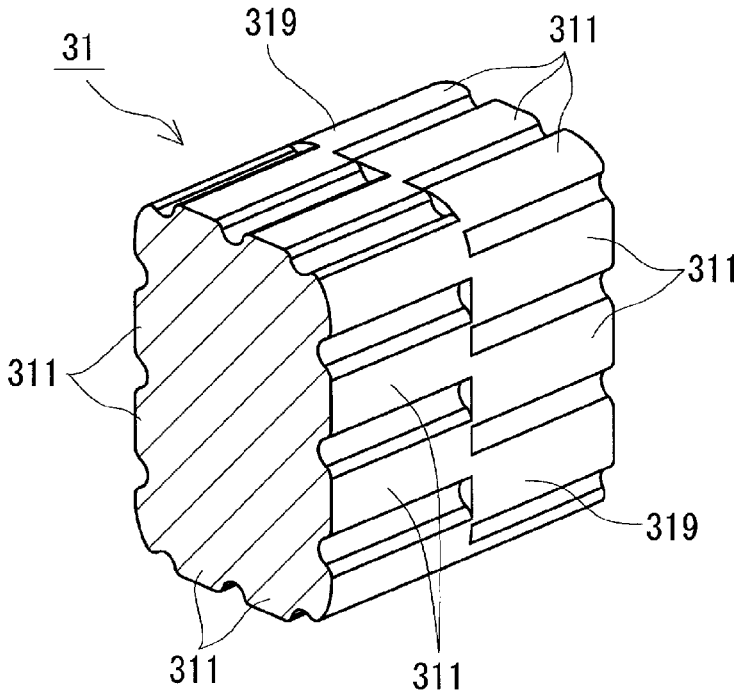
FIG. 6 is a schematic perspective view of an inner core portion different from FIG. 5.

Also, an inner interposed member that includes an inner peripheral face that conforms to the inner core portion 31 as shown in FIG. 6 may also be obtained. The inner core portion 31 in FIG. 6 has a configuration in which the core-side projecting portions 311 on one side in the axial direction of the inner core portion 31 and the core-side projecting portions 311 on the other side are displaced from each other in the circumferential direction of the inner core portion 31. When injecting resin from two end faces of the inner core portions 31, it is easy to supply resin into the entire core outer peripheral faces 319 of the inner core portions 31 due to the same reason as that of the configuration in FIG. 5. In addition, it is also possible that the core-side projecting portions 311 are further extended in the axial direction of the inner core portions 31, and grooves between the core-side projecting portions 311 adjacent to each other in the circumferential direction on one side and grooves between the core-side projecting portions 311 adjacent to each other in the circumferential direction on the other side are meshed with each other.

Method for Producing Reactor

The reactor 1 of Embodiment 1 can be produced by separately producing the coil 2, the molded core members 5A and 5B, and the outer core portions 32, and combining them. Specifically, the inner interposed members 41 of the molded core members 5A and 5B are inserted into the winding portions 2A and 2B of the coil 2, and the outer core portions 32 are arranged on the outer side of the end face interposed members 42 of the molded core members 5A and 5B. The outer core portions 32 may be joined to the end face interposed members 42 using an adhesive or the like.

Modified Example 1-1

The divided state of the magnetic core 3 and the insulating interposed member 4 is not limited to that illustrated in Embodiment 1. For example, it is also possible to use a pair of molded core members each substantially in the shape of the letter "n" obtained by molding a pair of inner core portions 31 with about half the length and one outer core portion 32 using a material of the insulating interposed member 4. Alternatively, it is also possible to use a pair of molded core members each substantially in the shape of the letter "L" obtained by molding one inner core portion 31 extending along the entire length of the winding portion 2A (2B) and one outer core portion 32 using a material of the insulating interposed member 4. Alternatively, it is also possible that two members obtained by molding the inner core portions 31 extending along the entire length of the winding portion 2A (2B) using the inner interposed members 41 are prepared, and two outer core portions 32 are combined therewith to form the magnetic core 3 and the insulating interposed member 4.

Modified Example 1-2

Contrary to the molded core members of Embodiment 1, it is also possible to use press-fitted core members obtained by forming the inner interposed members 41 through injection molding, and then press-fitting the inner core portions 31 to the inner interposed members 41. With the configuration in which the inner core portions 31 are press-fitted to the inner interposed members 41, the clearance between the inner core portions 31 and the inner interposed members 41 can be substantially 0 mm, that is, the inner core portions 31 and the inner interposed members 41 can be in substantially close contact with each other. The inner core portions 31 can be press-fitted to the inner interposed members 41 that have been already formed in this manner, because the inner interposed members 41 are constituted by the thin portions 41*a* and the thick portions 41*b* and thus can be produced at a high level of precision of dimensions.

Embodiment 2

In Embodiment 1, an aspect was described in which the coil 2 includes a pair of winding portions 2A and 2B. Meanwhile, a configuration similar to that of Embodiment 1 can be applied to a reactor including a coil having one winding portion.

When using a coil having one winding portion, a magnetic core may be formed by combining two molded core members each substantially in the shape of the letter "E" when viewed from above. In this case, a projecting portion located at the middle of the letter "E" of the molded core member is inserted into a winding portion to form an inner core portion. Furthermore, portions other than the projecting portion located at the middle of the letter "E" of the molded core member form an outer core portion. It is apparent that the divided state of the magnetic core and the insulating interposed member is not limited to the shape of the letter "E".

Applications

The reactor of the present disclosure can be utilized in a power conversion device such as a bidirectional DC-DC converter or the like that is installed in an electrically driven vehicle such as a hybrid car, an electric car, or a fuel cell car.

The invention claimed is:

1. A reactor comprising:

a coil having a winding portion;

a magnetic core having an inner core portion arranged inside the winding portion; and an inner interposed member for ensuring insulation between the winding portion and the inner core portion, wherein the inner interposed member includes a thin portion with a small thickness due to an inner peripheral face thereof being recessed, and a thick portion with a thickness larger than that of the thin portion, the inner core portion includes, on an outer peripheral face thereof facing the inner interposed member, a core-side projecting portion with a shape that conforms to a shape of the inner peripheral face of the thin portion, the thickness of the thin portion is 0.2 mm or more and 1.0 mm or less, and the thickness of the thick portion is 1.1 mm or more and 2.5 mm or less, the inner core portion and the inner interposed member are in substantially close contact with each other, and there is a clearance in at least part of a portion between the inner interposed member and the winding portion, and the clearance is more than 0 mm and 0.3 mm or less.

2. The reactor according to claim 1, wherein the inner interposed member is constituted by resin molded on an outer side of the inner core portion.

3. The reactor according to claim 1, wherein a difference between the thickness of the thin portion and the thickness of the thick portion is 0.2 mm or more.

4. The reactor according to claim 1, wherein the thickness of the thin portion is 0.2 mm or more and 0.7 mm or less, and the thickness of the thick portion is 1.1 mm or more and 2.0 mm or less.

5. The reactor according to claim 1, wherein a plurality of the thick portions and a plurality of the thin portions are present in a dispersed manner in a circumferential direction of the inner interposed member.

6. The reactor according to claim 1, wherein at least part of the thick portion reaches an end face of the inner interposed member in an axial direction of the winding portion.

7. The reactor according to claim 1, wherein an outer peripheral face of the inner interposed member has a shape that conforms to an inner peripheral face of the winding portion.

8. The reactor according to claim 1, wherein a thickness of the inner interposed member gradually increases from the thin portion toward the thick portion.

* * * * *